United States Patent [19]

Nagayama

[11] Patent Number: 4,483,607

[45] Date of Patent: Nov. 20, 1984

[54] RECORDING SYSTEM

[75] Inventor: Haruhiko Nagayama, Machida, Japan

[73] Assignee: Ricoh Company, Ltd., Japan

[21] Appl. No.: 529,541

[22] Filed: Sep. 6, 1983

[30] Foreign Application Priority Data

Sep. 6, 1982 [JP] Japan ..... 57-134227[U]
Dec. 29, 1982 [JP] Japan ..... 57-202125[U]

[51] Int. Cl.[3] ..... G03G 15/00
[52] U.S. Cl. ..... 355/3 TR; 355/3 BE
[58] Field of Search ..... 355/3 BE, 3 TR, 3 CH; 198/806, 807, 810

*Primary Examiner*—John Gonzales
*Assistant Examiner*—David Warren
*Attorney, Agent, or Firm*—Guy W. Shoup

[57] ABSTRACT

A recording system capable of detecting a deviation from a normal path of travel of an endless belt recording member trained over a plurality of rollers including a displacing roller supported at one end for pivotal movement and at the other end for displacing movement in a vertical direction and effecting correction of irregularities in the movement of the endless belt recording member. A guide member located above a side portion of a corona discharger for effecting transfer-printing of a toner image on a transfer-printing sheet in the vicinity of the displacing roller is moved in displacing movement conjointly with the displacing movement of the displacing roller, to thereby keep the clearance between the surface of the recording member and the corona discharger substantially constant at all times.

4 Claims, 10 Drawing Figures

RECORDING SYSTEM

FIELD OF THE INVENTION

This invention relates to recording systems in general, and more particularly it is concerned with a recording system comprising a recording medium in the form of an endless belt trained over a plurality of rollers and having a toner image formed thereon which is printed on a transfer-printing sheet by means of a corona discharger.

DESCRIPTION OF THE PRIOR ART

Figure 1:
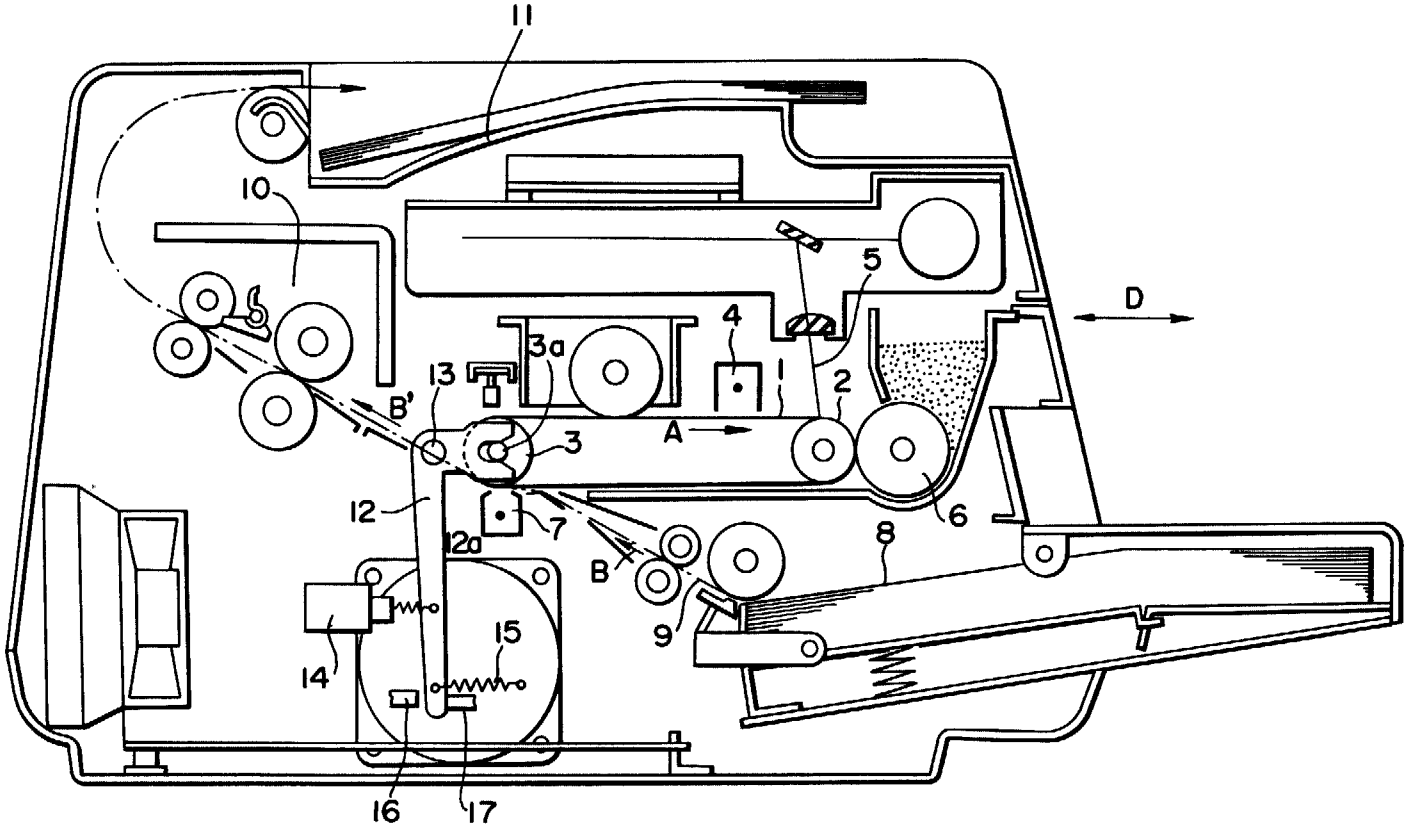
FIG. 1 is a schematic view of a recording system of the prior art using a recording member in the form of an endless belt.

One example of the recording system of the type described of the prior art is shown in FIG. 1.

FIG. 1 is a schematic view of a recording system constructed as a laser printer of the electrophotographic printing type, in which the reference numeral 1 designates a recording medium in the form of a photosensitive member of an endless belt type trained over a drive roller 2 and a follower roller 3. The drive roller 2 is driven by drive means, not shown, to rotate in a clockwise direction to move the photosensitive endless belt member 1 in the direction of an arrow A. As the photosensitive endless belt member 1 moves in this way, a portion thereof is charged by a charger 4 and an electrostatic latent image of a document to be recorded is formed on the surface of the charged portion of the photosensitive endless belt member 1 by a laser beam 5. The electrostatic latent image is developed by a developing device 6 into a visible image or a toner image, not shown, by means of a toner. The toner image is printed by transfer-printing by means of a corona discharger 7 on a transfer-printing sheet 9 fed from a sheet feeding section 8 in the direction of an arrow B in synchronism with the formation of the toner image on the photosensitive endless belt member 1. The corona discharger 7 is located in a position below the follower roller 3. After having the toner image formed thereon by transfer-printing, the transfer-printing sheet 9 is stripped off the photosensitive endless belt member 1 by virture of its firmness and the curvature of the lower run of the endless belt member 1 in the vicinity of the follower roller 3, to be fed in the direction of an arrow B'. The transfer-printing sheet 9 fed in t his direction is fed to a fixing device 10, from which it is transferred to a discharge stacker 11.

In the recording system of the aforesaid construction, the photosensitive endless belt member 1 might be prevented from moving along a predetermined path of travel due possibly to a difference in its length between opposite side edge portions or a local frictional dragging applied to the belt during travel. The tendency of the photosensitive endless belt member 1 to deviate from its normal path of travel would increase with time if it is allowed to operate without any means of correction. When this phenomenon occurs, the position in which an image is formed on the photosensitive endless belt member 1 and the position in which a transfer-printed image is formed on a transfer-printing sheet would be displaced from the normal position. Also, the photosensitive endless belt member 1 would be prevented from being driven for operation normally, and a side edge portion thereof would be damaged.

To obviate this problem, a proposal has been made by the applicant of the subject application to provide a correction device for correcting irregularities in the movement of the photosensitive endless belt member in which a displacing roller pivotally supported at one end for vertical movement at the other end is used as the follower roller 3 so that the follower roller can be moved vertically in displacing movement when any deviation of the photosensitive endless belt member 1 from its normal path of travel is detected. One example of such device will be described by referring to FIGS. 1–3.

Prior to the description of the correction device, the follower roller section of the recording system of the prior art will be outlined. As shown in FIG. 1, the follower roller 3 constructed as a displacing roller is pivotally supported at one end thereof (an end opposite the end of the follower roller shown in the plane of FIG. 1) and has at the other end thereof a bearing 3*a* fitted in a difurcation 12*a* formed at one end of a control arm 12 which is in the form of a letter L and pivotally supported at the junction of its long and short legs by a pin 13 secured to a machine frame, not shown. A solenoid 14 of a self-holding type and a tension spring 15 are mounted on opposite sides of the other end portion of the control arm 12. Stoppers 16 and 17 are mounted on opposite sides of the other end of the control arm 12 to regulate the amount of pivotal movement of the cotnrol arm 12. Upon energization of the solenoid 14, the control arm 12 is pulled toward the solenoid 14 and moved in a clockwise direction about the pin 13 against the biasing force of the spring 15 until the other end thereof abuts against the stopper 16, so that the end of the follower roller 3 located in the plane of the figure is moved downwardly to a position in which it is lower by about 0.75 mm than the position in which it would be disposed if the follower roller 3 were located horizontally. Thus the end of the follower roller 3 in the plane of FIG. 1 is located at a lower level than the end thereof opposite the end shown in FIG. 1. Upon de-energization of the solenoid 14, the control arm 12 is moved by the biasing force of the spring 15 about the pin 13 in a counterclockwise direction until it abuts against the stopper 17. Thus, the end of the follower roller 3 located in the plane of FIG. 1 is moved upwardly to a position in which it is higher by about 0.75 mm than the position in which it would be disposed if the follower roller 3 were located horizontally, and the end of the follower roller 3 located in the plane of FIG. 1 is disposed at a higher level than the end thereof opposite the end shown in FIG. 1.

Figure 2:
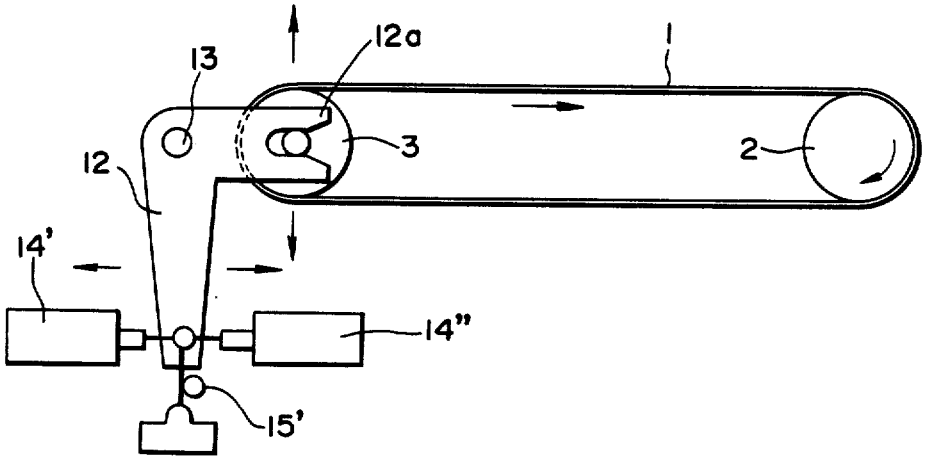
FIG. 2 is a front view of a correction device for correcting irregularities in the movement of the recording member to avoid an excessive deviation of the recording member from its normal path of travel.

The correction device of the prior art referred to hereinabove which is incorporated in the recording system shown in FIG. 1 will now be described. Referring to FIG. 2, solenoids 14' and 14" are located symmetrically on opposite sides of the other end portion of the control arm 12 and connected thereto in a manner to hold same therebetween, and a spring click 15' is mounted below the other end of the control arm 12. When the solenoid 14' is energized, the control arm 12 is moved in a clockwise direction about the pin 13 and the end of the follower roller 3 in the plane of FIG. 2 moves downwardly by about 0.75 mm from the position in which it would be disposed if the follower roller 3 were located horizontally, so that the end of the follower roller 3 located in the plane of FIG. 2 is kept at a level by about 0.75 mm than the opposite end of the follower roller 3 with respect to the horizontal. Conversely, when the solenoid 14" is energized, the control arm 12 is moved in a counterclockwise direction about the pin 13 and the end of the follower roller 3 in the plane of FIG. 2 moves upwardly by about 0.75 mm from the position in which it would be disposed if the follower roller 3 were located horizontally, so that the end of the follower roller 3 located in the plane of FIG. 2 is kept at a level higher by about 0.75 mm than the opposite end of the follower roller 3 with respect to the horizontal. The control arm 12 is held in the two positions referred to hereinabove by the spring click 15'.

Figure 3:
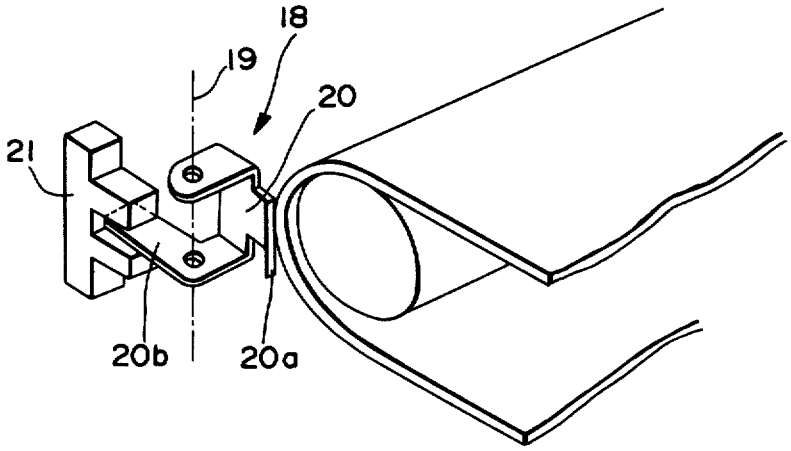
FIG. 3 is a perspective view of one example of the belt displacement detecting means used with the correcting device.

Control of a current passed to the solenoids 14' and 14" is effected by a signal produced by belt deviation detecting means 18 shown in FIG. 3. The belt deviation detecting means 18 comprises a pair of feelers 30 (only one feeler is shown in FIG. 3) each located in the vicinity of one of opposite ends of the follower roller 3 and supported by a shaft 19. Each feeler 20 comprises a contacting portion 20*a* kept in contact with the respective opposite side edge of the photosensitive endless belt member 1, and a light intercepting and admitting portion 20*b* located opposite the contacting portion 20*a* so as to be able to intercept a light ray emanating from a light source 21 or to allow same to pass therethrough.

The belt deviation detecting means 18 of the aforesaid construction operates as follows. When the photosensitive endless belt member 1 deviates from its normal path of travel and the amount of deviation exceeds a predetermined level, the feeler 20 located at the end of the follower roller 3 at which deviation of the photosensitive endless belt member 1 takes place is moved to allow a light beam emanating from the photointerrupter 21 to be interrupted or admitted by the light interrupting and admitting section 20*b*, to thereby turn on the phototinterrupter 21. For example, if the photointerrupter 21 located at the end of the follower roller 3 located in the plane of FIG. 2 is turned on, then the solenoid 14" is energized and the end of the follower roller 3 located in the plane of FIG. 2 becomes higher than the opposite end thereof. Conversely, if the photointerrupter 21 located at the end of the follower roller 3 disposed opposite the end located in the plane of FIG. 2 is turned on, then the solenoid 14' is energized and the end of the follower roller 3 located in the plane of FIG. 2 becomes lower than the opposite end thereof.

By using the correction device of the aforesaid construction, it is possible to positively detect any deviation of the photosensitive endless belt member 1 from its normal path of travel and make it move in the predetermined path of travel, so that the problems referred to hereinabove which are caused by deviation of the belt member 1 can be obviated. However, the belt deviation detecting means 18 would suffer the disadvantage that when the follower roller 3 is displaced in such a manner that the end of the roller 3 opposite the end thereof in the plane of FIG. 2 moves to a higher elevation, the gap between the corona discharger 7 and the side edge of the photosensitive endless belt member 1 at the opposite end of the follower roller 3 might become too large. Thus even if discharging is effected by means of the corona discharger 7, the transfer-printing sheet 9 might not be brought into contact with the surface of the photosensitive endless belt member 2. More specifically, if the clearance between the corona discharger 7 and the photosensitive endless belt member 1 becomes too large, a reaction offered by the firmness of the transfer-printing sheet 9 and other factors to the electrostatic force generated by the discharging effected by the corona discharger 7 and tending to force the transfer-printing sheet 9 against the surface of the photosensitive endless belt member 1 might overcome the electrostatic force, with a result that the transfer-printing sheet 9 might be prevented from coming into contact with the surface of the photosensitive endless belt member 1 to a satisfactory degree. When this phenomenon occurs, it would be difficult to positively print the toner image by transfer-printing on the transfer-printing sheet 9 so that the image formed by transfer-printing would not be clearly defined and become blurred. This fogging phenomenon is more marked when the firmness of the transfer-printing sheet is higher.

SUMMARY OF THE INVENTION

This invention has been developed for the purpose of obviating the aforesaid disadvantages of the prior art. Accordingly, the invention has as its object the provision of a recording system which is capable of eliminating the occurrence of a phenomenon of fogging which might otherwise occur when transfer-printing is performed by using the belt deviation correction device of the type which relies on a displacement of one end of the follower roller constructed as a displacing roller.

The aforesaid object is accomplished according to the invention by providing, in a recording system of a construction defined in the preamble of the claim, the features comprising a transfer-printing sheet guide member located adjacent a corona discharger and having two end portions, one end portion corresponding to one end of a displacing roller being pivotally supported and the other end portion corresponding to the other end of the displacing roller being vertically displaceable, a shield formed integrally with the transfer-printing sheet guide member or as a separate entity and attached to the transfer-printing sheet guide member to provide a guide means of unitary structure and arranged above an edge portion of the corona discharger over which a transfer-printing sheet is fed, and coupling means for coupling the other end portion of the transfer-printing sheet guide member to the other end of the displacing roller so that the other end portion of the transfer-printing sheet guide member can be moved in a vertical direction as the other end of the displacing roller moves in a vertical direction, whereby the shield can at least be moved upwardly along with the transfer-printing sheet guide member through the coupling means as the displacing roller is moved upwardly.

The recording system according to the invention is capable of positively eliminating the occurrence of a phenomenon of fogging when a toner image is printed on a transfer-printing sheet by transfer-printing which has often occured in the prior art due to the use of a follower roller in the form of a displacing roller. Moreover, the movement of the transfer-printing sheet guide member taking place conjointly with the shield increases the efficiency with which transfer-printing is effected when the one end of the displacing roller is moved upwardly. The provision of the transfer-printing sheet guide member and the shield as a unitary structure eliminates the risk of a sheet jamming. The efficiency with which transfer-printing is effected can be further increased by the fact that the transfer-printing sheet guide member and the shield define as opening for a corona discharge current to flow therethrough from the corona discharger.

The recording system according to the invention can be incorporated not only in a laser printer of the electrophotographic type but also in an electrophotographic apparatus of other type and an electrostatic recording apparatus.

DETAILED DESCRIPTION OF THE PREFERRED EMBODIMENTS

Preferred embodiments of the invention will now be described by referring to the accompanying drawings.

Figure 4:
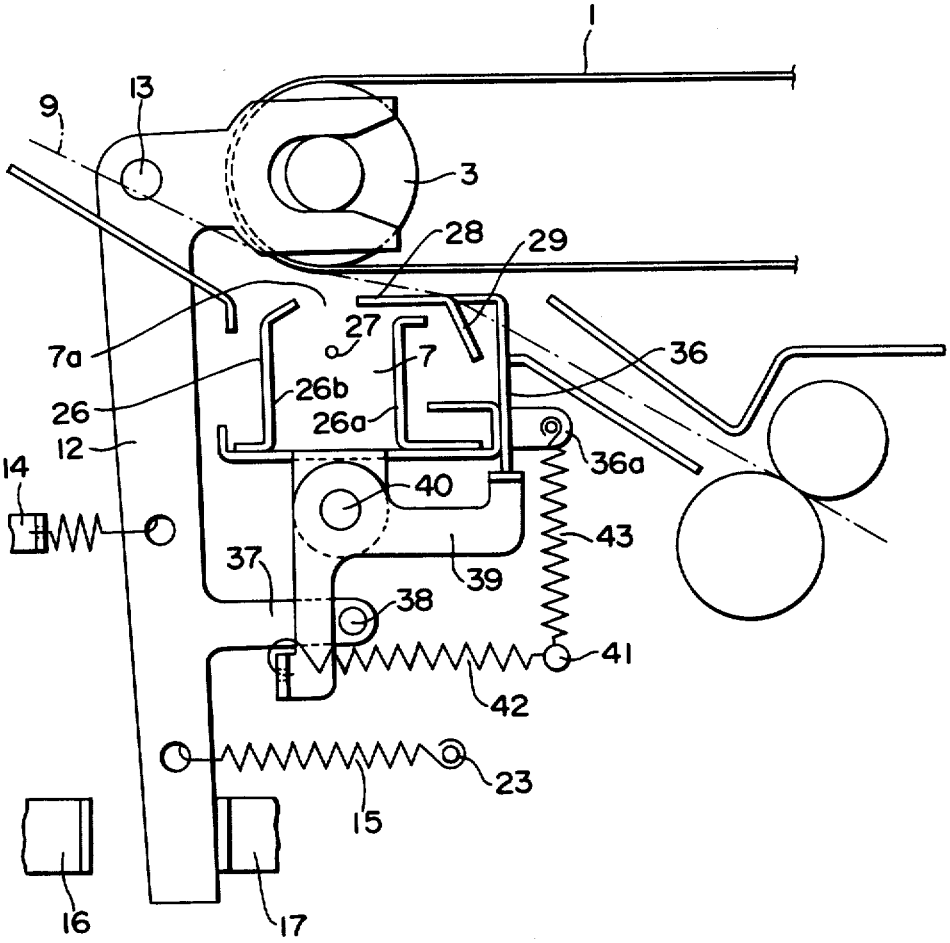
FIGS. 4 and 5 are front views, on an enlarged scale, of the follower roller section of the recording system comprising one embodiment of the invention, showing the follower roller section in different modes of operation.
Figure 5:
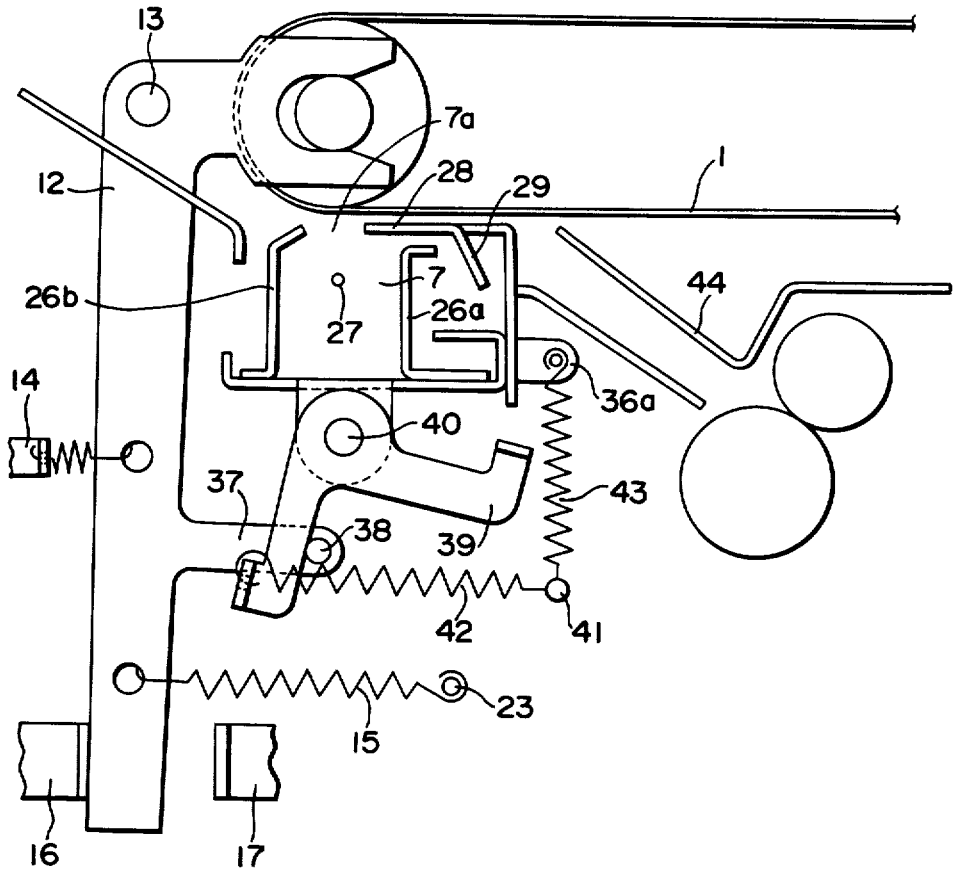

FIGS. 4 and 5 show, on an enlarged scale, of the follower roller section of the recording system comprising one embodiment, in which parts similar to those shown in FIGS. 1 and 3 are designated by like reference characters. The correction device used in the invention is distinct from the correction device shown in FIG. 2 and comprises a solenoid 14 and a tension spring 15 which serves as a first tension spring in this embodiment, in place of the solenoids 14' and 14" shown in FIG. 2. The first tension spring 15 is connected at one end to a pin 23 and at the other end to the control arm 12 which is normally urged to move in a counterclockwise direction about the pin 13. The reference numerals 16 and 17 designate stoppers. When the solenoid 14 is de-energized, the control arm 12 is brought into abutting engagement with the stopper 17 as shown in FIG. 4; when it is energized, the control arm 12 is brought into abutting engagement with the stopper 16, so that the control arm 12 can be moved in pivotal movement between these two positions.

The corona discharger 7 comprises, as is known, a casing 26 and a charge wire 27. The casing 26 comprises two side walls **26*a* and 26*b*, one side wall 26*a* located on a side over which a transfer-printing sheet is fed is smaller in height than the other side wall 26*b*, and a shield 28 is located above the one side wall 26*a*. Thus, an upper portion of the other side wall 26*b* and a left end portion of the shield 28 define therebetween an opening 7*a* for a corona discharge current generated by the corona discharger 7 and flowing to the photosensitive endless belt member 1** to flow therethrough.

Figure 6:
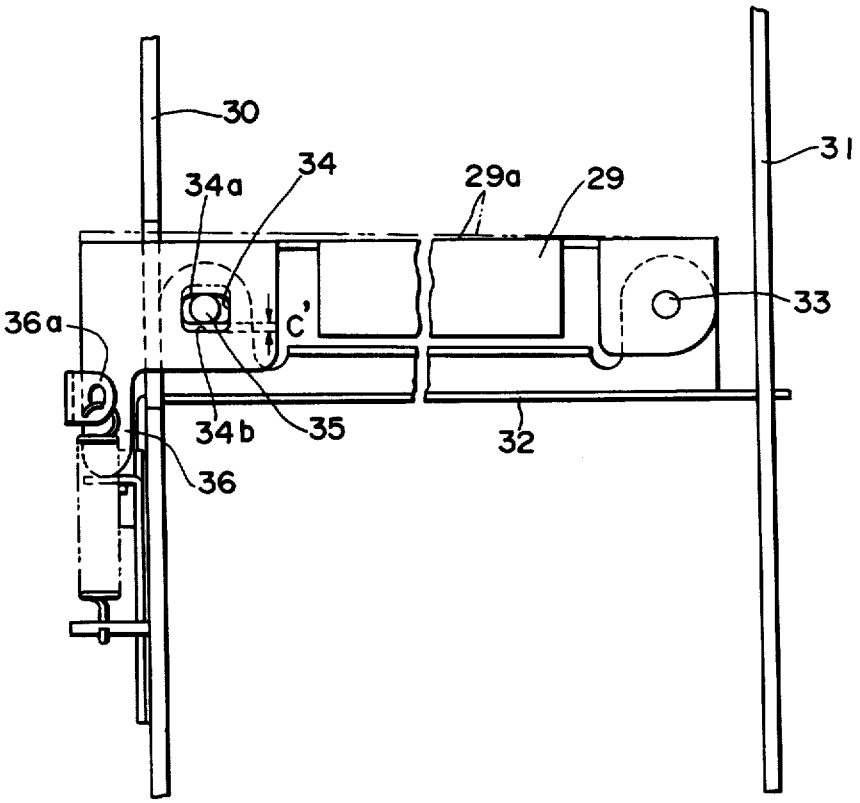
FIG. 6 is a side view of the guide means shown in FIGS. 4 and 5.

The shield 28 is formed integrally with a transfer-printing sheet guide member 29 located in close proximity to the right side of the transfer-printing corona discharger 7 in FIGS. 4 and 5. Alternatively, the shield 28 may be formed as a separate entity and connected to the transfer-printing sheet guide member 29 to provide a unitary structure. In this case, the shield 28 is connected to the guide member 29 in such a manner that there is no difference in vertical height at least between upper surfaces of the shield 28 and guide member 29. The shield 28 and member 29 constitute guide means. As shown in FIG. 6, the guide member 29 is pivotally supported at one end portion thereof corresponding to one end of the follower roller 3 through a pin 33 by a support plate 32 secured to side plates 30 and 31 and has an aperture 34 formed at the other end portion thereof corresponding to the other end of the follower roller 3 for loosely receiving a regulating pin 35 secured to the support plate 32. That is, the guide plate 32 is arranged in such a manner that the end thereof in the planes of FIGS. 4 and 5 can be displaced vertically and the opposite end is supported for pivotal movement, as is the case with the follower roller 3. The magnitude of pivotal movement of the guide member 29 may vary depending on a gap C' formed between the aperture 34 and the pin 35. The guide member 29 has a guide surface **29*a* the right end thereof being lower than the right end by C'/2 (half of the gap C') when the regulating pin 35 abuts against an upper edge 34*a* of the aperture 34 designated by a solid line in FIG. 6 and a left end of the guide surface 29*a* becomes higher than a right end thereof by a magnitude substantially equal to C'/2 (half of the gap C') when the regulating pin 35 abuts against a lower edge 34*b* of the aperture 34 designated by an irregularly broken line in FIG. 6. A downwardly extending arm 36 is formed integrally with the guide member 29 at the other end thereof for abutting contact at its lower end with an intermediate lever 39 as presently to be described. The gap C' is set at about 1.5 mm. The downwardly extending arm 36 has been described as being formed integrally with the guide member 29. However, the invention is not limited to this construction of the arm 36 and it may be formed separately from the guide member 29** and connected thereto to provide a unitery structure.

Referring to FIGS. 4 and 5 again, the control arm 12 includes an actuating arm 37 formed integrally with the control arm 12 and extending from a portion thereof slightly below a central portion in a horizontal direction. The actuating arm 37, which may be formed as a separate entity and connected to the control arm 12, has a pin 38 secured to its forward end. The intermediate lever 39 pivotally supported by a shaft 40 is interposed between the pin 38 and the arm 36. The intermediate lever 39 which is substantially in the form of a letter L includes a downwardly extending portion that can be brought at its right side edge into abutting engagement with the pin 38 and a rightwardly extending portion having an upwardly protruding rightmost end portion that can be brought into abutting engagement with the lower end of the arm 36 as described hereinabove. Resilient means in the form of a second tension spring 42 is connected at one end to a pin 41 and at the other end to the intermediate lever 39 so that the intermediate lever 39 is normally urged by the biasing force of the second tension spring 42 to move in a counterclockwise direction about the shaft 40. Resilient means in the form of a third tension spring 43 is connected at one end to the pin 41 and at the other end to a tongue **36*a* attached to the arm 36, so that the guide member 29 is normally urged by the biasing force of the third tension spring 43 to move in a counterclockwise direction about the pin 33**.

In this embodiment, the intermediate lever 39, second tension arm 42 and third tension arm 43 constitute coupling means coupling the guide member 29 to the control arm 12 so that the guide member 29 can be displaced in accordance with the displacement of the control arm 12.

The embodiment of the recording system constructed as aforesaid operates as follows. Assume that the solenoid 14 is energized. Then the control arm 12 is kept in abutting engagement with the stopper 16, as shown in FIG. 5. When the control arm 12 is in this position, the pin 38 presses against the intermediate lever 39 against the biasing force of the second tension spring 42, and the guide member 29 is kept by the biasing force of the third tension spring 43 in a position in which the regulating pin 35 is positioned against the upper edge 34*a* of the aperture 34. The end of the follower roller 3 located in the plane of FIG. 5 is disposed in a position lower than the position of the opposite end of the follower roller 3, so that the photosensitive endless belt member 1 will tend to shift gradually toward the end of the follower roller 3 located in the plane of FIG. 5 and deviate from its normal path of travel. When the amount of deviation of the photosensitive endless belt member 1 from its normal path of travel exceeds a predetermined level, such deviation is detected by the detecting means 18 which generates a signal to de-energize the solenoid 14.

Upon de-energization of the solenoid 14, the control arm 12 is moved in the counterclockwise direction about the pin 13 by the biasing force of the first tension spring 15, into a position in which it abuts against the stopper 17. As the control arm 12 moves as aforesaid, the pin 38 of the actuating arm 37 shifts rightwardly, so that the intermediate lever 39 is moved in pivotal movement about the shaft 40 in the counterclockwise direction by the biasing force of the second tension spring 42. Thus the intermediate lever 39 is brought into abutting engagement with the arm 36 and moves same upwardly, to keep the guide member 29 in a position in which the lower edge 34*b* of the aperture 34 is positioned against the regulating pin 35 (FIG. 4). Meanwhile the follower roller 3 displaced by the pivotal movement of the control arm 12, so that the end of the follower roller 3 located in the plane of FIG. 4 is disposed in a position higher than the position of the opposite end of the follower roller 3. Therefore, the clearance between the corona discharger 7 and the photosensitive endless belt number 1 becomes too large, and if this condition is allowed to exist, the phenomenon of fogging of the transfer-printed image would occur due possibly to insufficient contact between the transfer-printing sheet and the photosensitive endless belt member 1. In the present invention, however, the guide member 29 coupled to the control arm 12 is displaced simultaneously as the control arm 12 moves in pivotal movement as aforesaid and the end of the guide member 29 located in the plane of FIG. 4 moves to a position higher than the position of the opposite end guide member 29. Since the shield 28 is unitary with the guide member 29, the end of the shield 28 in the plane of FIG. 4 moves to a position higher than the position of the opposite end of the shield 28. Even if such condition exists, it is possible to keep the clearance between the photosensitive endless belt member 1 and the guide means constituted by the guide member 29 and shield 28 at a desired level. This makes it possible to positively bring the transfer-printing sheet 9 into contact with the surface of the photosensitive endless belt member 1 when transfer-printing is carried out. More specifically, when transfer-printing is performed, the transfer-printing sheet 9 is guided by the guide means constituted by the guide member 29 and shield 28 and moves through a position which is close to the surface of the photosensitive endless belt member 1. Thus, even if the photosensitive endless belt member 1 is spaced apart a large distance from the corona discharger 7, the transfer-printing sheet 9 can be readily brought into contact with the surface of the photosensitive endless belt member 1. If the guide member 29 were separated from the shield 28, the leading end of the transfer-printing sheet 9 might enter the gap separating the guide member 29 from the shield 28, thereby causing a jam of transfer-printing sheet to occur. In the invention, the shield 28 is integral with the guide member 29 and there is no difference in vertical level between their top surfaces, so that the risk of the aforesaid jamming occurring in the recording system according to the invention can be avoided.

As the recording operation is performed while the recording system is in the condition shown in FIG. 4, the photosensitive endless belt member 1 will gradually shift toward the end of the follower roller 3 opposite the end thereof in the plane of FIG. 4. When the amount of deviation of the belt member 1 exceeds the predetermined level, it is detected by the detecting means and the solenoid 14 is energized. Thus the control lever 12 is moved in pivotal movement in the clockwise direction in FIG. 4, so that the follower roller 3 is displaced in a manner to bring the position of its end located in the plane of FIG. 4 to a lower level than the position of the opposite end. At the same time, the guide member 29 is also displaced in a manner to bring the position of its end located in the plane of FIG. 4 to a lower level than the position of the opposite end, by the biasing force of the third tension spring 43 as the intermediate lever 39 moves pivotally in the clockwise direction. Thus, the follower roller section of the recording system is restored to the condition shown in FIG. 5.

In the recording system of the aforesaid construction according to the invention, damage to the photosensitive endless belt member 1 is avoided by allowing the belt member 1 to deviate from its normal path of travel in a predetermined allowable range alternately on opposite ends of the follower roller 3, and the occurrence of fogging in transfer-printed images is prevented which might be caused by an increase in the clearance between the photosensitive endless belt member 1 and the corona discharger 7. Moreover, the construction in which the guide member 29 and the shield 28 are formed integrally to provide guide means is conducive to prevention of jamming of the transfer-printing sheet 9. In the event that the shield 28 for the corona discharger 7 is formed integrally with the side wall 26*a* of the casing 26 and stationary, the value of the discharge current which is about 19–20 $\mu$A when the end of the follower roller 3 located in the plane of FIGS. 4 and 5 is displaced downwardly would be reduced to about 15 $\mu$A when the clearance between the opening 7*a* of the corona discharger 7 and the surface of the photosensitive endless belt member 1 increases as a result of an upward displacement of the end of the follower roller 3 located in the plane of FIGS. 4 and 5. In the recording system according to the invention, however, when one end of the follower roller 3 is displaced upwardly, the corresponding end of the shield 28 is also upwardly displaced, to thereby prevent the clearance between the opening 7a of the corona discharger 7 and the surface of the photosensitive endless belt member 1 from increasing. Thus the drop in the value of the discharge current only drops to about 18 μA and no marked reduction occurs in the efficiency with which transfer-printing is carried out.

Figure 7:
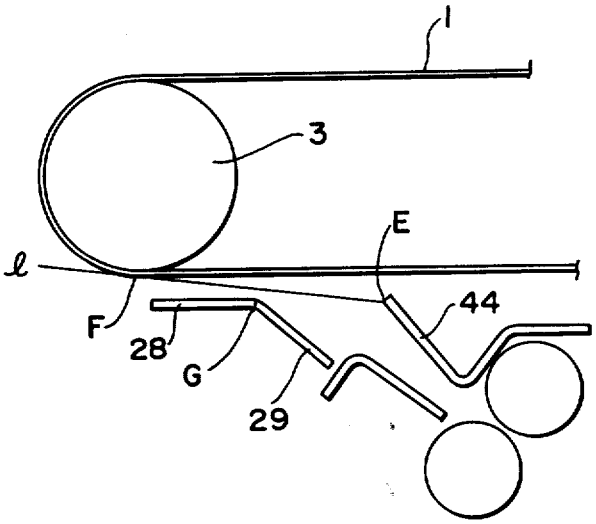
FIG. 7 is a view in explanation of the position in which the guide means shown in FIGS. 4–6 according to the invention is located.

In the recording system according to the invention, the guide means constituted by the shield 28 and the guide member 29 is disposed relative to the parts in its vicinity in such a manner that when the bent between the guide member 29 and the shield 28, the forward end of an upper conveyor guide plate 44 and the lowermost portion of the follower roller 3 are designated by G, E and F respectively, G is disposed below the straight line l connecting E and F together as shown in FIG. 7, even when the end of the follower roller 3 located in the plane of FIG. 7 is displaced downwardly. By this arrangement, the leading end of the transfer-printing sheet 9 remains held between a pair of fixing rollers, and the fluttering of the transfer-printing sheet 9 can be minimized when the trailing end of the sheet 9 clears the point E. Thus a reduction in the efficiency of transfer-printing can be avoided.

Figure 8:
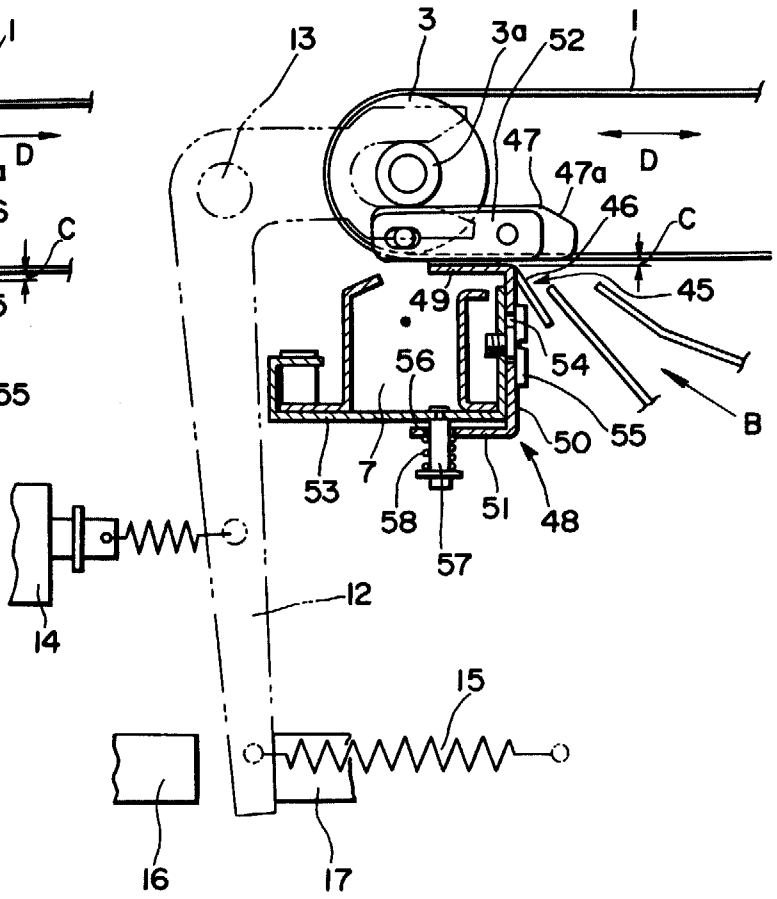
FIGS. 8 and 9 are front views, on an enlarged scale, of the follower roller section of the recording system comprising another embodiment of the invention.
Figure 9:
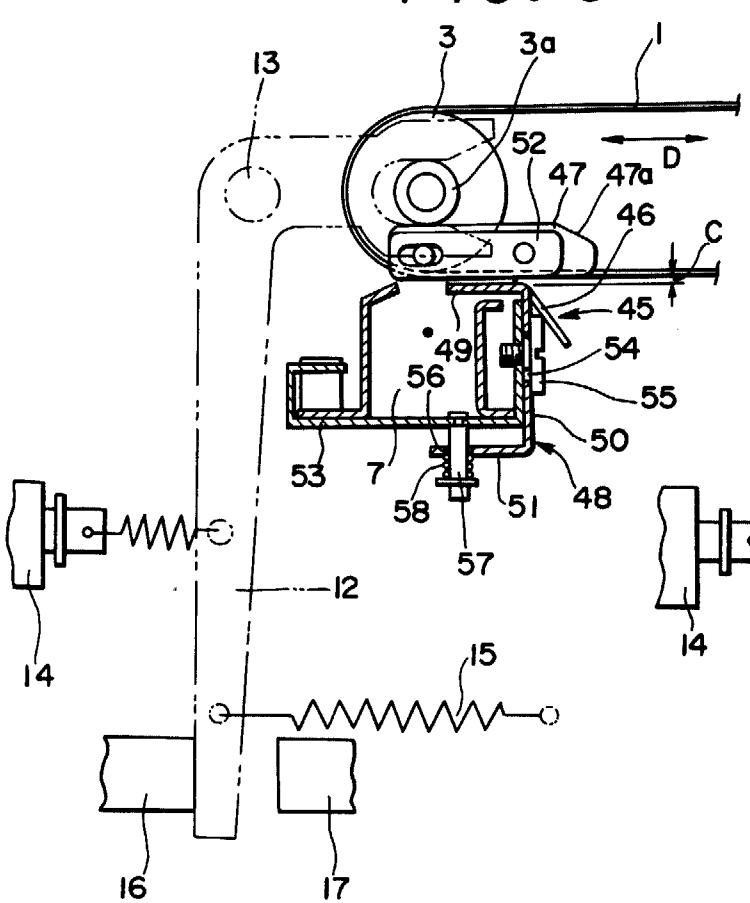
Figure 10:
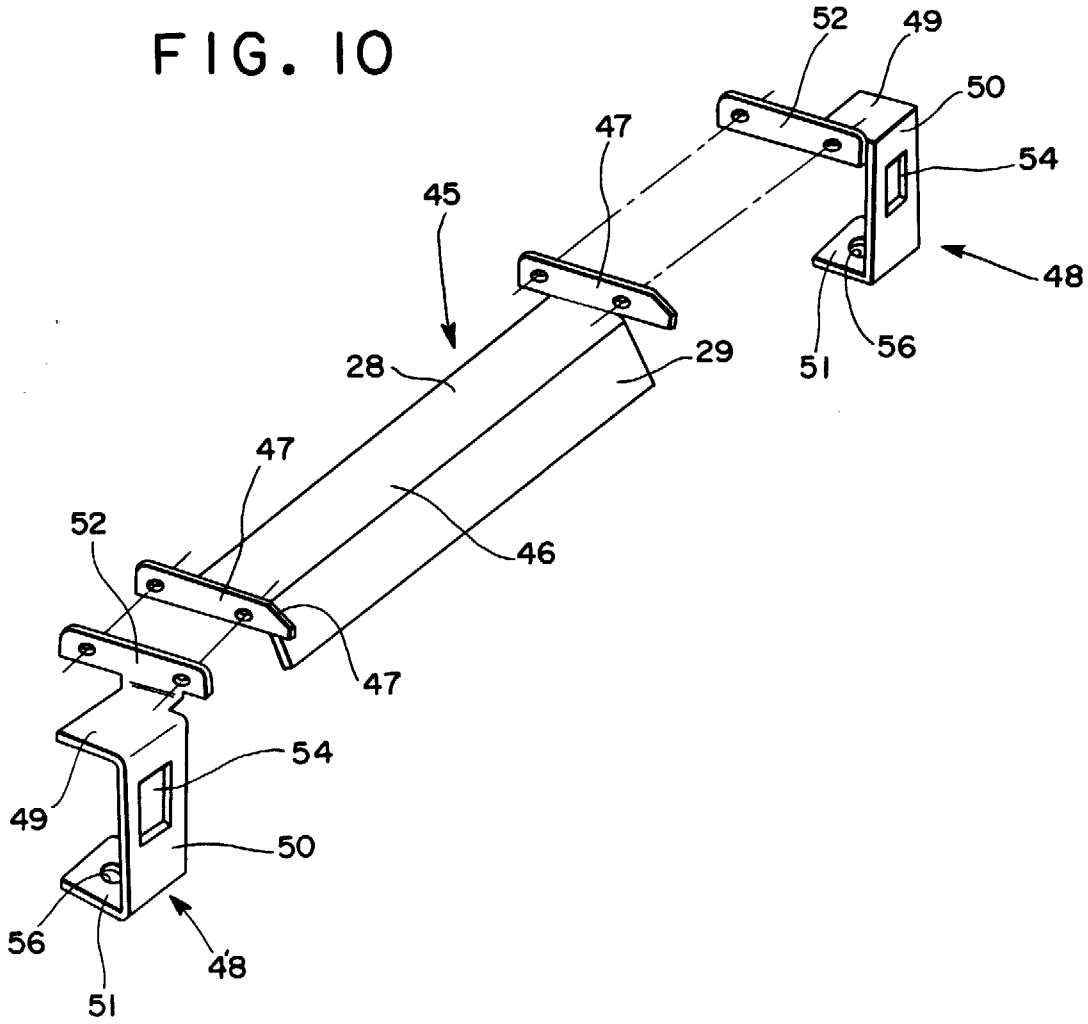
FIG. 10 is an exploded perspective view of a modification of the guide means.

FIGS. 8–10 show another embodiment of the recording system in conformity with the invention, in which guide means 45 located rightwardly of the corona discharger 7 in adjacent relation comprises a guide member 46, and bearing guide members 47 each secured to one of opposite ends of the guide member 46. Support members 48 are each joined as by spot welding to one of the bearing guide members 47. As shown in FIG. 8, the guide member 46 is downwardly inclined at its right end portion and its left end portion is extended as fas as the discharging zone of the corona discharger 7 to facilitate guiding to a transfer-printing position of the transfer-printing sheet fed in the direction of an arrow B. Stated differently, the corona discharger 7 is constructed such that a discharge current flows through an opening defined by a forward end of a left side wall of its casing and a left end of the guide member 46.

The bearing guide member 47 are each in the form of a rectangular plate arranged to have its major dimension located horizontally and in contact at a top surface with an outer peripheral surface of one of the bearings 3a supporting the follower roller 3 at opposite ends thereof. Each bearing guide member 47 is formed with an inclined surface 47a at its upper right end corner.

The support members 48 are each formed of a plate bent substantially in the form of a letter U standing on its side and comprise an upper plate portion 49, a side plate portion 50 and a lower plate portion 51. The upper plate portion 49 has a lug 52 attached thereto for having one of the bearing guide members 47 secured thereto. The side plate portion 50 is formed with an aperture 54 which is larger in size than the amount of movement of the guide means 45 and has connected thereto a support 53 for supporting the corona discharger 7 for movement, as shown in FIGS. 8 and 9. A stepped screw 55 threadably connected to the rails 53 is loosely fitted in the aperture 54, so that the guide means 45 can be moved vertically as the stepped screw 53 is moved in the aperture 54. The lower plate portion 51 is formed with an aperture 56 which receives a stud 57 secured to the support 53. Resilient means in the form of a compression spring 58 is mounted between a head of the stud 57 and the lower plate portion 51 to normally urge the guide means 45 to move upwardly by its biasing force. This ensures that the bearing guide member 47 are brought into contact with the respective bearings 3a for the follower roller 3, so as to keep a spacing C between a top surface of the guide member 46 and the photosensitive endless belt member constant at all times.

The embodiment of the recording system constructed as aforesaid in conformity with the invention operates as follows. Assume that the solenoid 14 is energized. This brings the control arm 12 into abutting engagement with the stopper 16 as shown in FIG. 9. When the control arm 12 is in this condition, the end of the follower roller 3 located in the plane of FIG. 9 is disposed in a position lower than that of the opposite end of the follower roller 3 and consequently the spacing between the photosensitive endless belt member 1 and the corona discharger 7 is reduced on the side edge portion of the belt 1 corresponding to the end of the follower roller 3 located in the plane of FIG. 9. The guide means 45 follows up the follower roller 3 and is located in an inclined position. Thus, as the biasing guide members 47 are brought into pressing contact with the bearings 3a for the follower roller 3 and the end of the follower roller 3 located in the plane of FIG. 9 is displaced downwardly as aforesaid, the guide member 46 of the guide means 45 is also displaced downwardly at an end thereof corresponding to the end of the follower roller 3 in the plane of FIG. 9. Therefore, the spacing C between the top surface of the guide member 46 of the guide means 45 and the photosensitive endless belt member 1 can be kept at a predetermined level.

If the follower roller 3 is displaced as aforesaid, the photosensitive endless belt member 1 gradually deviates from its normal path of travel and shifts toward the end of the follower roller 3 in the plane of FIG. 9 which is downwardly displaced, as recording operations are repeatedly performed. When this deviation exceeds a predetermined allowable range, it is detected by the detecting means 18 shown in FIG. 3 which produces a signal to de-energize the solenoid 14.

Upon de-energization of the solenoid 14, the control arm 12 is pivotally moved in a counterclockwise direction about the shaft 13 by the biasing force of the tension spring 15 into abutting engagement with the stopper 17, as shown in FIG. 8. As the control arm 12 moves in pivotal movement as aforesaid, the follower roller 3 is displaced so that the end thereof located in the plane of FIG. 8 is displaced to a position which is higher than the position of the opposite end of the follower roller 3. At the same time, the guide means 45 is also displaced through the compression springs 58 in such a manner that the end thereof corresponding to the end of the follower roller 3 located in the plane of FIG. 8 is displaced to a position higher than the position of the opposite end thereof. At this time, the bearing guide members 47 are kept in a position in which they are in pressing engagement with the respective bearings 3a for the follower roller 3 by virtue of the fact that the follower roller 3 is indirectly held in place by the stopper 17. Thus, the spacing C between the top surface of the guide member 46 of the guide means 45 and the photosensitive endless belt member 1 can be kept at the predetermined level.

In this way, the clearance C between the photosensitive endless belt member 1 and the guide means 45 can be kept constant at all times. Thus, even if the gap between the corona discharger 7 and the photosensitive endless belt member 1 becomes too great, it is possible to let the transfer-printing sheet 9 pass through a position close to the photosensitive endless belt member 1.

This is conductive to prevention of the occurrence of fogging in transfer-printed images.

What is claimed is:

1. A recording system comprising:

a recording member in the form of an endless belt;

at least two rollers including a displacing roller supported for pivotal movement at one end thereof and displaceable in a vertical direction at the other end thereof, said at least two rollers having said recording member in the form of an endless belt trained thereover;

a correction device for correcting irregularities in the movement of said recording member in the form of an endless belt, said correction device being operative to move the other end of said displacing roller in displacing movement in a vertical direction when a deviation of the recording member from its normal path of travel exceeds a predetermined level, to return the recording member to its normal path of travel; and a corona discharger located in the vicinity of said displacing roller for effecting the transfer to a printing sheet of a toner image formed on a surface of said recording member; wherein the improvement comprises:

a guide member located adjacent said corona discharger and having two end portions, one end portion corresponding to said one end of said displacing roller and supported for pivotal movement and the other end portion corresponding to the other end of said displacing roller capable of moving in displacing movement in a vertical direction;

a shield formed integral with said guide member and arranged above a side portion of said corona discharger over which a transfer-printing sheet is fed to a clearance between said corona discharger and the surface of said recording member in the form of an endless belt, said shield cooperating with said guide member to provide guide means; and coupling means coupling said displacing roller to said guide member so that the other end portion of said guide member can be moved in displacing movement in a vertical direction conjointly with the vertical displacing movement of the other end of said displacing roller caused to take place by said correction device, whereby said shield cooperating with said guide member to constitute guide means can be displaced upwardly through said coupling means when said displacing roller is at least displaced upwardly.

2. A recording system as claimed in claim 1, wherein said shield and said guide member are formed as separate entities and connected together to provide a unitary structure.

3. A recording system comprising:

a recording member in the form of an endless belt;

at least two rollers including a displacing roller supported for pivotal movement at one thereof and displaceable in a vertical direction at the other end thereof, said at least two rollers having said recording member in the form of an endless belt trained thereover;

a correcting device for correcting irregularities in movement of said recording member in the form of an endless belt, said correcting device being operative to move the other end of said displacing roller in displacing movement in vertical direction when a deviation of the recording member from its normal path of travel exceeds a predetermined level, to return the recording member to its normal path of travel; and a corona discharger located in the vicinity of said displacing roller for effecting transfer-printing on a transfer-printing sheet a toner image formed on a surface of said recording member; wherein the improvement comprises:

a guide member located adjacent said corona discharger and capable to move in a direction in which said displacing roller moves in displacing movement;

a pair of bearing guide members each secured to one of opposite ends of said guide member to press against one of bearings journalling said displacing roller at opposite ends thereof, said bearing guide members and said guide members constituting guide means;

a pair of support members each joined to one of said bearing guide members; and resilient means urging by its biasing force said guide member to move in a direction in which the force with which said bearing guide members press against the corresponding bearings for the displacing roller is increased, whereby a clearance between said recording member and said guide member can be kept substantially constant at all times.

4. A recording system as claimed in claim 3, wherein a portion of said guide member is located in a corona discharge zone of said corona discharger.

* * * * *